United States Patent [19]

Morton

[11] 4,270,071

[45] May 26, 1981

[54] COMPOSITE BASE AND BALLAST MEMBER FOR COMPACT SINGLE-ENDED FLUORESCENT LAMP

[75] Inventor: Edward W. Morton, Teaneck, N.J.

[73] Assignee: Westinghouse Electric Corp., Pittsburgh, Pa.

[21] Appl. No.: 97,278

[22] Filed: Nov. 26, 1979

[51] Int. Cl.[3] ..... H05B 41/16

[52] U.S. Cl. ..... 315/62; 313/204; 315/53; 315/58

[58] Field of Search ..... 315/50–53, 315/57, 58, 62, 70, 71, 112, 244, 291; 313/493, 204; 339/112 R, 117 R, 144 R, 146; 307/157

[56] References Cited

U.S. PATENT DOCUMENTS

| | | | |
|---|---|---|---|
| 3,521,120 | 7/1970 | Anderson | 315/57 |
| 3,815,080 | 6/1974 | Summa | 315/57 X |
| 3,899,712 | 8/1975 | Witting | 313/493 |
| 3,953,761 | 4/1976 | Lo Giudice | 315/71 |
| 4,082,981 | 4/1978 | Morton et al. | 315/53 X |
| 4,117,372 | 9/1978 | Walz | 313/204 X |
| 4,173,730 | 11/1979 | Young et al. | 315/53 |

FOREIGN PATENT DOCUMENTS 2155488 5/1972 Fed. Rep. of Germany .

OTHER PUBLICATIONS

Westinghouse Lamp Division Lighting Handbook, Jun. 1961, pp. 3–32 and 3–33.

*Primary Examiner*—Eugene R. LaRoche
*Attorney, Agent, or Firm*—W. D. Palmer

[57] ABSTRACT

Composite base member for operatively retaining a compact, single-ended fluorescent lamp which has an elongated but retroflexed or curved envelope. The base member has a hollow body with a mounting means which divides the hollow body into two sections. A ballast inductor is mounted on one side of the mounting means and a ballast capacitor is mounted on the other side of the mounting means so that the two components are separated, with the ambient atmosphere facilitating ballast component cooling. The mounting means also has the lamp mounted thereon. The composite base member is compact and relatively light and the ballast components operate in series circuit as a lead-type ballast, with the efficiency of operation being good.

9 Claims, 8 Drawing Figures

COMPOSITE BASE AND BALLAST MEMBER FOR COMPACT SINGLE-ENDED FLUORESCENT LAMP

CROSS-REFERENCE TO RELATED APPLICATIONS

In copending application Ser. No. 011,836, filed Feb. 13, 1979 by Frederick W. Hoeh (deceased), which application is owned by the present assignee, is disclosed a single-ended compact fluorescent lamp having a tubular envelope of compact tridimensional configuration. The present composite base member is particularly adapted for use with a lamp such as is disclosed in this copending application.

In copending application Ser. No. 011,832 filed Feb. 13, 1979 by H. Skwirut, R. G. Young, and E. W. Morton, the present applicant, is disclosed a screw-in type lighting unit comprising a convoluted tridimensional fluorescent lamp of the compact type. The present composite base member and associated ballast can be used as the base member for the lamp disclosed in this copending application.

In copending application Ser. No. 097,279, filed concurrently herewith, by R. G. Young, and owned by the present assignee, is disclosed a single-ended multiple-folded compact lamp which provides a relativey high lumen output. The present composite base member which includes the lamp ballast can be used to mount and operate the lamp as disclosed in this copending application.

The application of a PTC resistor as a part of a ballast or current limiting device for a fluroescent lamp is disclosed in application Ser. No. 910,814, filed May 30, 1978, filed by Cadoff et al, now U.S. Pat. No. 4,162,430, issued July 24, 1979 and owned by the present assignee.

BACKGROUND OF THE INVENTION

This invention generally relates to compact fluorescent lamps and, more particularly, to a composite base member which includes a lamp ballast and electrical adapter and which is adapted to have operatively mounted thereon a single-ended fluorescent lamp of the compact type.

Preheat ballasts for fluorescent are well known and have been used for many years. In the simplest form of such ballast, when the starting voltage required for the lamp is not greater than the supply voltage, the ballast may be a simple inductor or choke which merely limits the current. Without power factor correction, such choke-type ballasts provide low power factors of about 45% to 60%. It is known to use separate capacitors with such a choke, in order to improve the power factor. Such ballast designs are generally discussed in the Westinghouse Lamp Division Lighting Handbook, revised June 1961, pages 3–32 and 3–33.

A series-connected choke and capacitor used to ballast a low pressure mercury discharge lamp are disclosed in German Pat. No. 2,155,488 dated May 31, 1972. A diode bridge plus PTC resistor plus a glow switch are used to provide ignition and reignition for the lamp.

A PTC resistor used to shunt a capacitor which serves as a part of a ballast impedance for fluorescent lamps is disclosed in U.S. Pat. No. 4,082,981, dated Apr. 4, 1978 to E. W. Morton, the present applicant.

Single-ended compact fluorescent lamps of various designs have received much attention in recent years due to the long life of such lamps and their improved efficiency of operation as compared to a conventional incandescent source. One type of such lamp is disclosed in U.S. Pat. No. 3,521,120, dated July 21, 1970 to J. M. Anderson wherein a radio-frequency power source is positioned in the base member of the lamp and is used to generate a radio frequency discharge within the lamp enevelope.

In the U.S. Pat. No. 3,815,080, dated June 4, 1974 to F. Summa is disclosed a fluorescent lamp adapter wherein a ballast transformer is positioned within a composite base member to which an elongaged fluorescent lamp is adapted to be affixed. This permits the insertion of a standard fluorescent lamp in an incandescent lamp socket fixture without modification.

In U.S. Pat. No. 3,953,761, dated April 27, 1976 to T. LoGiudice is disclosed a single-ended compact fluorescent lamp wherein convoluted envelopes of varying designes are wrapped about a central core which encloses the lamp ballast.

In U.S. Pat. No. 3,899,712, dated Aug. 12, 1975 to Witting is disclosed a compact single-ended fluorescent lamp wherein the envelope is provided with a helical shape with the lamp ballast enclosed within the centrally disposed channel which is enclosed by the helical shaped envelope.

SUMMARY OF THE INVENTION

There is provided a composite base member which includes a lamp ballast and electrical adapter member and which is adapted to have operatively mounted thereon a single-ended fluorescent lamp of the compact type. The lamp has an elongated envelope which is curved in predetermined fashion so that the maximum dimension of the volume occupied by the composite base member and mounted lamp is sufficiently small to permit same to be utilized as a light source for a conventional-type fixture which is normally intended to be operated with an incandescent lamp. The compact lamp per se is otherwise generally conventional and includes a pair of thermionic electrodes operatively positioned within the envelope proximate the ends thereof. A pair of lead-in conductors are sealed through the envelope ends and connect to the electrodes, and the envelope encloses a discharge-sustaining filling and has phosphor material carried on the interior surface thereof.

The composite base member comprises a hollow base member body having an open end portion, with the lamp envelope adapted to be mounted to the composite base member and to project from the open end of the housing body. An electrical adapter member having two terminals is affixed to and projects from the portion of the housing body with is opposite to the open end portion, and the electrical adapter member is operable to be connected to a source of household-type AC energy.

The ballast portion of the composite base comprises an inductor and the capacitor connected in series, with a reactance of the capacitor at household frequency being a predertermined amount greater than the reactance of the inductor. When the lamp is operatively connected in circuit to the composite base member, the series-connected inductor and capacitor are connected between one electrical terminal of the electrical adapter and one of the lead-in conductors which connect to one of the lamp electrodes, with the other lead-in conductor which connects to the said one electrode connected through a current-interrupting means to one of the lead-in conductors which connect to the other lamp electrode. To complete the circuit, the other lead-in conductor which connects to the other electrode is connected to the other electrical terminal of the adapter member. When the lamp is initially energized, the current-interrupting means completes the series circuit through the lamp electrodes in order to preheat same to a thermionic condition, and the current interrupting means thereafter opens to interrupt the series circuit, with the resulting inductive surge initiating an operating discharge between the lamp electrodes.

The hollow housing body has mounting means affixed thereto which defines separate sections. The capacitor portion of ballast is positioned on one side of the mounting means and the inductor portion of the ballast is positioned on the other side of the mounting means, in order to provide a spacing between these two ballast elements, and the inductor and capacitor have the ambient atmosphere in contact therewith to facilitate dissipation of heat therefrom. The foregoing ballast package which is formed as a part of a composite base provides very positive starting and the lamp operates with good efficiency, while still presenting a very compact and lightweight unit as desired for application in conventional household-type fixtures.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENT

Figure 1:
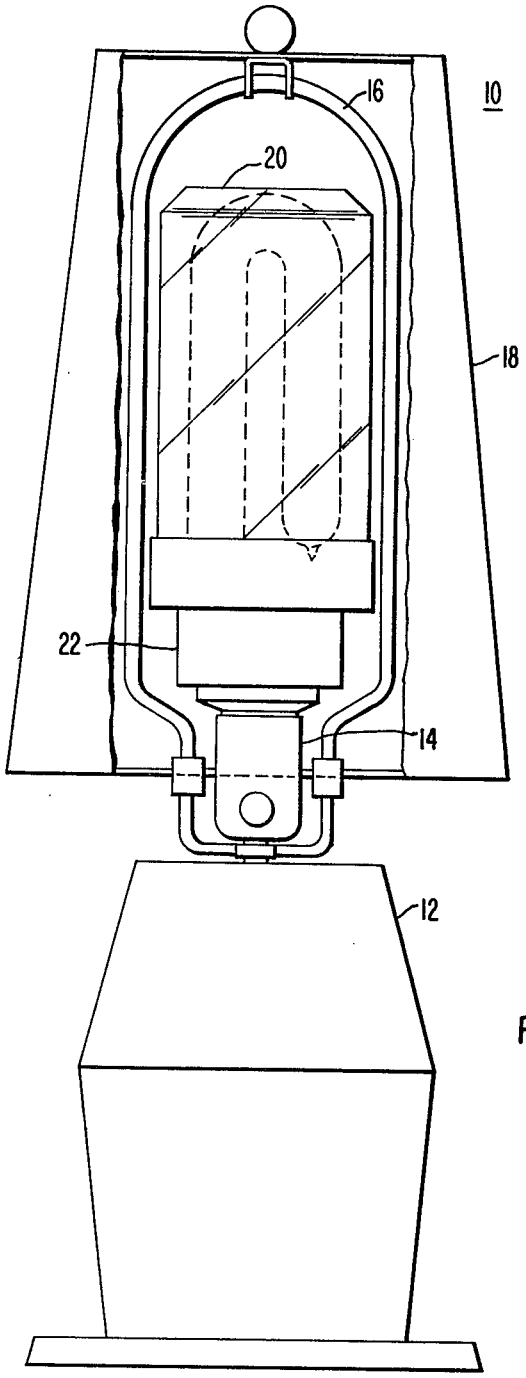
FIG. 1 is an elevational view, shown partly in section, of a conventional table fixture which has mounted therein a compact fluorescent lamp which incorporates the composite base member of the present invention.

With specific reference to the form of the invention illustrated in the drawings, the conventional table fixture 10 as shown in FIG. 1 comprises the usual fixture base 12, socket 14, mounting harp 16, and shade 18 which is suspended from the harp 16, with the shade 18 partially broken away to show the light source 20. In accordance with the present invention, a single-ended compact fluorescent lamp 20 which incorporates the present composite base member 22 is screwed into the socket 14 in order to provide a very efficient, long-life household light source.

Figure 3:
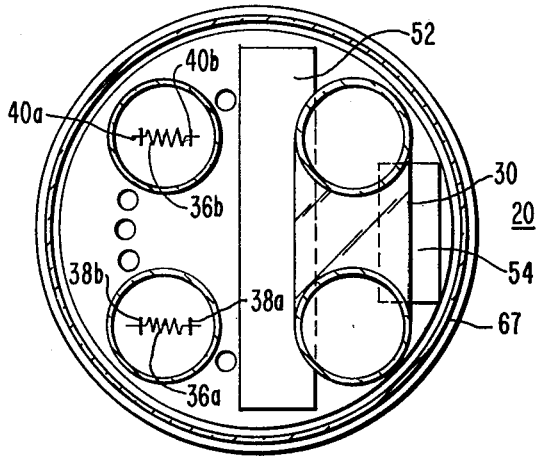
FIG. 3 is a sectional view of the lamp unit as shown in FIG. 2 taken on the line III-III in the direction of the arrows.
Figure 2:
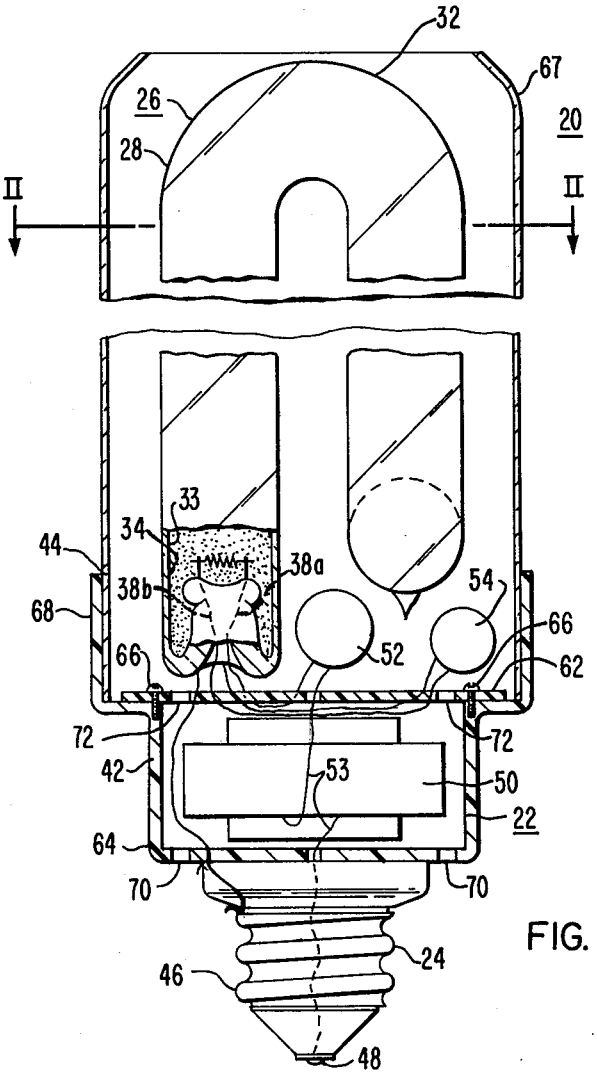
FIG. 2 is an elevational view, shown partly in section, of one embodiment of a composite base member which has a compact lamp unit mounted thereon.

One embodiment of the single-ended compact fluorescent lamp 20 is shown in FIGS. 2 and 3 wherein the composite base member 22 includes a lamp ballast and an electrical adapter member such as a screw type adaptor 24. The member 22 is adapted to have operatively mounted thereon the single ended fluorescent lamp 26 of the compact type. The lamp 26 has an elongated envelope 28 which is fabricated by sharply curving same proximate its midpoint to form a first bend 30, see FIG. 3, and the resulting once-bent envelope is thereafter bent a second time proximate the midpoint to form the bends 32. The envelope is thereafter coated with phosphor 33, lehred, exhausted and filled with the discharge-sustaining material such as a few torrs of inert, ionizable starting gas and a small charge of mercury 34. The envelope portion of the lamp can be provided with a wide variety of configurations which are curved or retroflexed in predetermined fashion so that the maximum dimension of the volume occupied by the composite base member and the lamp as operatively mounted thereon is sufficiently small to permit the unit to be utilized as the light source for a conventional-type fixture which is normally intended to be operated with an incandescent lamp, such as the table fixture 10 as shown in FIG. 1.

The lamp 26 incorporates a pair of thermionic electrodes **36*a* and 36*b* operatively positioned within the envelope 28 proximate the ends thereof and a pair of lead-in conductors 38*a*, 38*b* and 40*b* are sealed through the ends of the envelope and connect to each of the electrodes 36*a*, 36*b***.

In accordance with the present invention, the composite base member 22 comprises a hollow body 42 of predetermined dimensions and having an open end portion 44. The lamp 26 is adapted to be mounted to this composite base member 22 and to project from the open end 44 of the housing body 42. The electrical adapter member 24 has two terminals such as the base shell 46 and the center eyelet 48 and the adapter 24 is affixed to and projects from the portion of the hollow housing body 42 which is opposite to the open end portion 44 thereof. The electrical adapter member 24 is operable to be connected to a source of household-type AC energy, such as 120v 60Hz.

Figure 4:
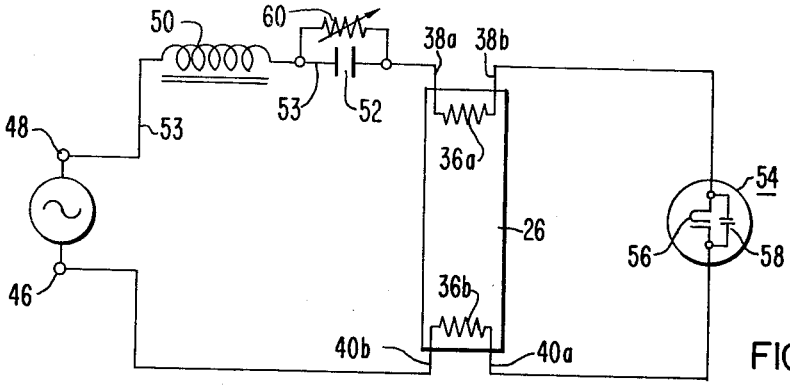
FIG. 4 is a circuit diagram of the preferred ballast circuit of the present invention.

The ballast portion of the base comprises an inductor or choke 50 and a capacitor 52, both connected in series by suitable conductors 53 and for a better description of the circuit, reference is also made to FIG. 4. For operating a 30 to 40 watt fluorescent lamp having a T8 size envelope (2.54 cm), the inductance of the choke 50 is 500 mh and the capacitance of capacitor 52 is 5 $\mu$f. With these values, the reactance of the capacitor 52 at household frequency is slightly greater than the reactance of the inductor 50, in order to cause the ballast to operate as a so-called lead-type circuit.

Referring to FIGS. 2 and 4, when the lamp 26 is operatively connected in circuit to the composite base member 22, the series-connected inductor 50 and capacitor 52 are connected between one electrical terminal 48 of the electrical adapter member 24 and one of the lead-in conductors **38*a* which connect to one of the lamp electrodes 36*a*. The other lead-in conductor 38*b* which connects to the electrode 36*a* is connected through a current-interrupting means 54 to one of the lead-in conductors 40*a* which connect to the other electrode 36*b***.

The other lead-in conductor 40b which connects to the other electrode 36b is connected to the other electrical terminal 46 of the electrical adapter member 24. Upon energization of the lamp as connected in circuit, the current interrupting means 54 completes a series circuit through the lamp electrodes 36a, 36b to preheat same to a thermionic condition. The current interrupting means 54 thereafter opens to interrupt the series circuit with the resulting inductive surge initiating an operating discharge between the lamp electrodes 36a, 36b.

The current interrupting means 54 can take any of several designs and in the embodiment as shown, this has the form of a conventional glow switch 56 and paralleling condenser 58 to minimize rf interference during lamp starting. The glow switch could be replaced by a thermal switch or push-button or a solid-state device, all of which are well known.

In the circuit diagram as shown in FIG. 4, the capacitor 52 is paralleled by a variable resistor 60 which has a positive temperature coefficient (PTC) of resistance. An application of such a so-called PTC resistor is shown in aforementioned U.S. Pat. No. 4,082,981, dated Apr. 4, 1978. Such a variable resistor need not be used, but if it is, it is selected to display a curve of resistivity verses temperature such that when the lamp as connected in circuit is initially energized, the capacitor 52 is effectively by-passed by the variable resistor 60, in order to increase the initial current through the series circuit and accentuate the preheating of the lamp electrodes. Once the lamp is operating, the variable resistor 60 displays sufficient resistance that it is effectively removed from the circuit. Specific PTC materials are disclosed in aforementioned application Ser. No. 910,814, filed May 30, 1978, now U.S. Pat. No. 4,162,430.

Referring to FIG. 2, there is included within the hollow housing body 42 a mounting member 62 which is affixed within the housing body and defines separate sections. The housing body 42 and mounting member 62 can be formed of metal or plastic. As a specific example, the mounting member 62 is a generally flat plate, preferably plastic, of such dimensions as to overlap the lower base section 64 which encloses the inductor 50, and the mounting member 62 is affixed thereto by suitable means such as screws 66. The capacitor 52 is positioned on one side of the mounting plate means 62 and the inductor 50 is positioned on the other side of the mounting plate 62, in order to provide a spacing between these two ballast elements. Both the inductor 50 and capacitor 52 have the ambient atmosphere in contact therewith to facilitate dissipation of heat therefrom. In the preferred form of the invention, the lamp 26 is also mounted on the mounting member 62 by relatively stiff lead-in conductors 38a, 38b, 40a, 40b affixed thereto, along with the capacitor 52 and glow starter 56. To complete the preferred embodiment of the lamp, the envelope 28 preferably is surrounded by a light shield or light-diffusing member 67 which preferably is open at the top. This member 67 fits into a thin cylindrical shaped-rim 68 which forms the open end 44 of the composite housing body 22. A first series of apertures 70 are provided through the housing body about the electrical adapter member 24 and a second series of apertures 72 are provided through the mounting plate 62 in order to provide a chimney cooling effect and flow ambient air into contact with the ballast elements 50 and 52.

Figure 6:
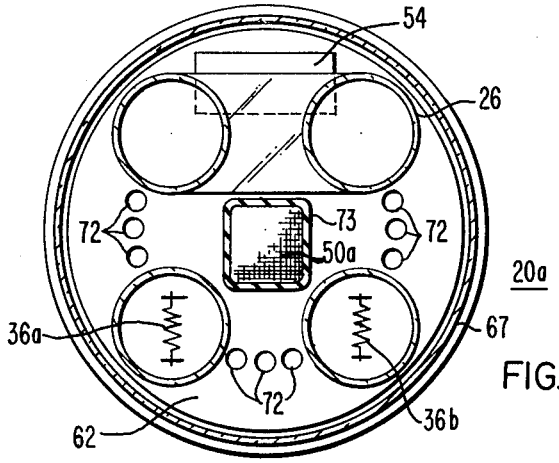
FIG. 6 is a sectional view of the lamp unit as shown in FIG. 5 taken on the line VI-VI in the direction of the arrows.
Figure 5:
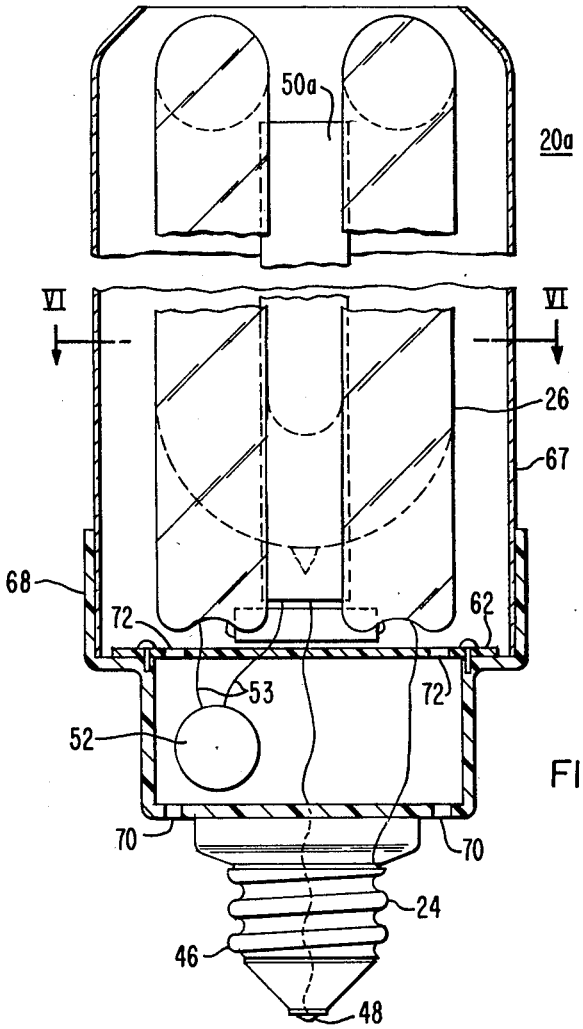
FIG. 5 is an elevational view, shown partly in section, of a lamp embodiment generally similar to that as shown in FIG. 2 except that the inductor is provided with a so-called finger-type design.

In the embodiment as shown in FIGS. 2 and 3, the inductor 50 is affixed within the base housing 42 on the opposite side of the mounting member 62 from that side on which the lamp 26 is adapted to be mounted. The capacitor 52 is mounted on the member 62 on the same side which the lamp 26 is adapted to be mounted. These elements can be reversed and such an embodiment 20ais shown in FIGS. 5 and 6 wherein inductor 50a is formed in the configuration of a so-called finger choke which has an elongated configuration and is provided with a light-reflecting coating 73 on the exterior surface thereof. In this embodiment, the finger choke 50a is affixed to the upper side of the mounting member 62, which is the same side to which the lamp 26 is adapted to be mounted, and the capacitor 52 is affixed within the hollow housing body 42 on the opposite side of the mounting member 62 from that side to which the lamp 26 is affixed. In this manner, these ballast elements are separated from one another, with the general design otherwise remaining as described for the embodiment 20 as shown in FIGS. 2 and 3, including the apertures 70 and 72 which provide the chimney effect.

Figure 8:
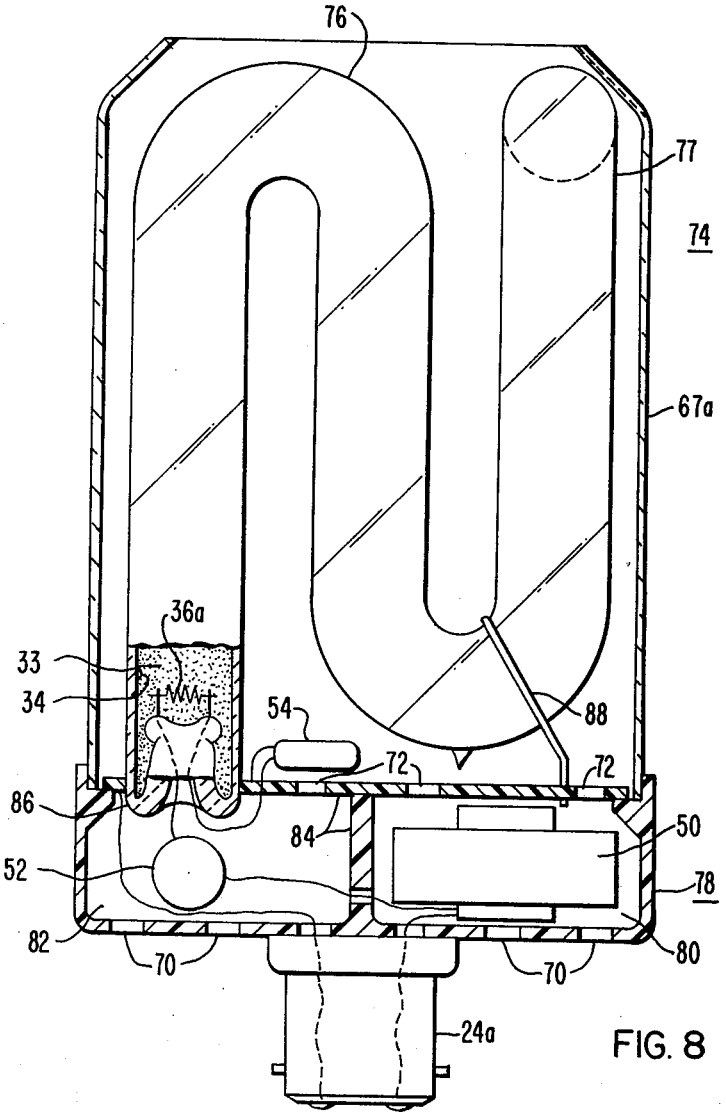
FIG. 8 is an elevational view, shown in partly in section, of the lamp unit which is shown in FIG. 7.
Figure 7:
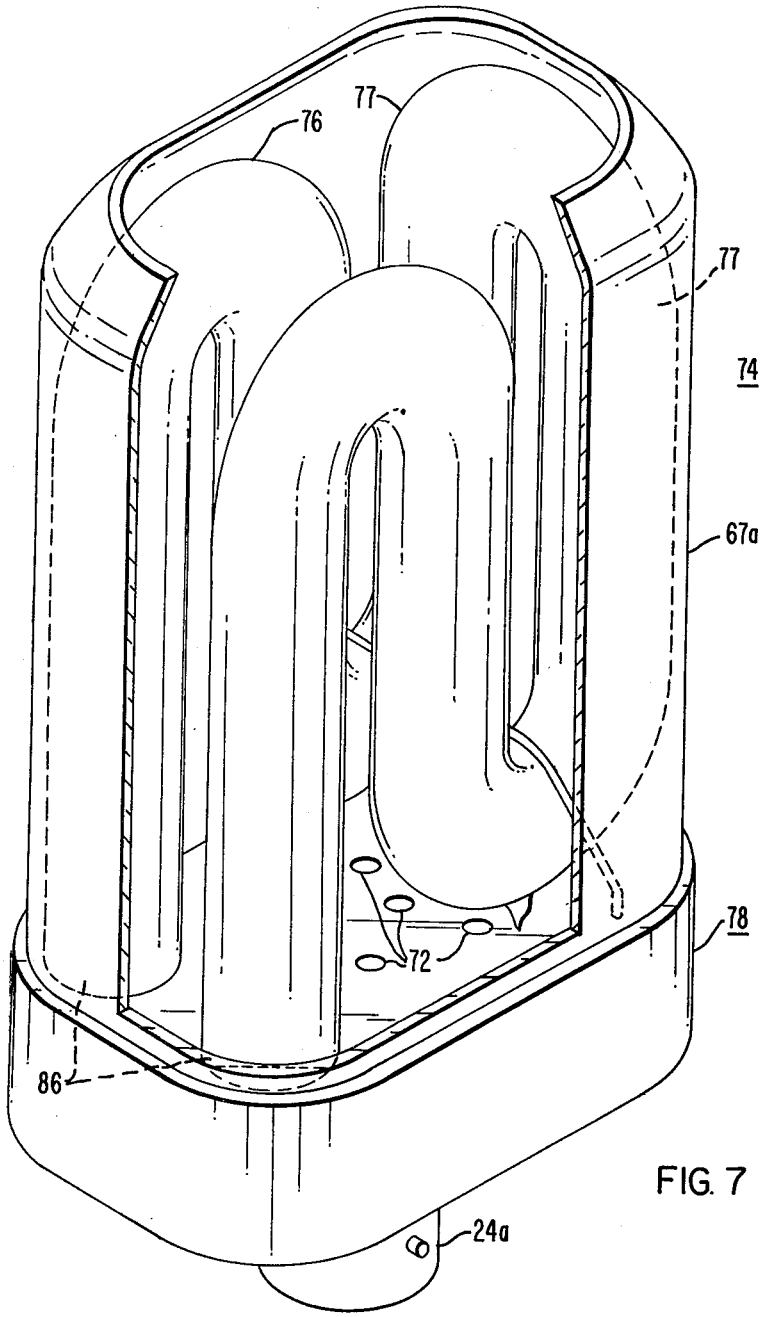
FIG. 7 is an isometric view, partly broken away, of an another embodiment wherein the lamp envelope is provided with multiple retroflexed portions in order to increase the length of the discharge path.

In FIG. 7 is shown an isometric view of another lamp embodiment 74 in which the envelope 76 is provided with additional retroflexed portions 77, in order to increase the length of the discharge path and thus the wattage input and light output of the composite unit. The construction details for this embodiment 74 are shown in FIG. 8 wherein the composite base unit 78 is divided into two sections 80 and 82 by a modified mounting member 84 which serves to retain the lamp unit 76 and also to separate the ballast inductor 50 and capacitor 52 from one another. As in the previous embodiments, apertures 70 and 72 and the modified light diffuser 67a provide the chimney effect to ensure that the ambient air contacts the ballast components to effect a cooling thereof. Such an embodiment utilizes a modified base adapter 24a which is provided with a bayonet-type configuration. The end portions 86 of the envelope 76 are recessed into the upper surface of the mounting member 84 for purposes of support. An additional support 88 is provided for the envelope 76. Other components are as previously described.

The present ballast can be used to operate single ended compact fluorescent lamps which have an output in the order of 2,000 lumens, with a wattage input of about 40 watts. This is an efficiency improvement of more than 300% as compared to a standard incandescent lamp of similar lumen output. In addition, as compared to a standard single lamp preheat type commercial ballast, the present lightweight ballast displays an efficiency of operation which is improved by approximately 6% over the standard ballast. The voltage regulation is also very good. For operating with the values of inductance and capacitance as previously outlined, the composite ballast weights approximtely 8.3 ounces and can be fitted into a 2.5 inch (6.35 cm) cube. In contrast, the usual commercial ballast of equivalent ballasting capacity measures 5 inches (12.7 cm)×1.5 inches (3.8 cm)×1.875 inches (4.8 cm) and weighs 29.5 ounces. Such compact size and light weight is of course highly desirable for use in a retrofit type application, an example being a conventional-type table fixture.

I claim:

1. A composite base member including a lamp ballast and electrical adapter member and adapted to have operatively mounted thereon a single-ended fluorescent lamp of the compact type, said lamp having an elongated envelope which is curved in predetermined fashion so that the maximum dimension of the volume occupied by said composite base member and said lamp as operatively mounted is sufficiently small to permit same to be utilized as the light source for a conventional-type fixture normally intended to be operated with incandescent lamp means, a pair of thermionic electrodes operatively positioned within said envelope proximate the ends thereof, a pair of lead-in conductors sealed through the ends of said envelope and connecting to each of said electrodes, and said envelope enclosing a discharge-sustaining filling and having phosphor material carried on the interior surface thereof, said composite base member comprising:

(a) a housing body having a hollow configuration of predetermined dimensions and having an open end portion, said lamp envelope adapted to be mounted to said composite base member and to project from the open end of said housing body, said electrical adapter member having two terminals and affixed to and projecting from the portion of said housing body which is opposite to the open end portion thereof, and said electrical adapter member operable to be connected to a source of household-type AC energy;

(b) said ballast comprising inductor means and capacitor means connecting in series circuit, the reactance of said capacitor means at household frequency being a predetermined amount greater than the reactance of said inductor means; when said lamp is operatively connected in circuit to said composite base member, said series-connected inductor means and capacitor means are connected between one electrical terminal of said electrical adapter member and one of said lead-in conductors which connect to one of said lamp electrodes, the other of said lead-in conductors which connect to said one lamp electrode is connected through a current-interrupting means to one of said lead-in conductors which connect to said other electrode, and the other of said lead-in conductors which connect to said other electrode is connected to said other electrical terminal of said electrical adapter member; upon energization of said lamp as connected in circuit, said current-interrupting means completing a series circuit through said lamp electrodes to preheat same to a thermionic condition, and said current interrupting means thereafter opening to interrupt the series circuit with the resulting inductive surge initiating an operating discharge between said lamp electrodes; and (c) mounting means affixed within said housing body and defining separate sections, said capacitor means positioned on one side of said mounting means and said inductor means positioned on the other side of said mounting means to provide a spacing between these two ballast elements, and said inductor means and said capacitor means having the ambient atmosphere in contact therewith to facilitate dissipation of heat therefrom.

2. The composite base member as specified in claim 1, wherein said lamp envelope is adapted to be mounted on said mounting means and project from the open end of said housing of said composite base member.

3. The composite base member as specified in claim 2, wherein said inductor means is affixed within said housing on the opposite side of said mounting member from that side on which said lamp envelope is adapted to be operatively mounted, and said capacitor means is mounted on said mounting member on the same side which said lamp envelope is adapted to be operatively mounted.

4. The composite base member as specified in claim 2, wherein said capacitor means is affixed within said housing on the opposite side of said mounting member from that side on which said lamp envelope is adapted to be operatively mounted, and said inductor means is mounted on said mounting member on the same side which said lamp envelope is adapted to be operatively mounted.

5. The composite base member as specified in claim 4, wherein said inductor means has an elongated configuration and projects from the open end portion of said housing in the general direction of said lamp envelope as operatively mounted on said base member.

6. The composite base member as specified in claim 2, wherein said current interrupting means is a glow-starter mounted on said mounting member means on the same side thereof that said lamp envelope is adapted to be mounted.

7. The composite base member as specified in claim 1, wherein the open end portion of said housing body has a thin rim which is adapted to receive and retain a light-diffusing overfitting member.

8. The composite base member as specified in claim 1, wherein apertures are provided through the wall of said housing body about said electrical adapter member, and apertures are also provided through said mounting means to provide a chimney effect to bring ambient air into contact with said ballast.

9. The composite base member as specified in claim 1, wherein a variable resistor having a positive temperature coefficient of resistance connects in parallel with said capacitor means, said variable resistor displaying a curve of resistivity vs. temperature such that when said lamp as connected in circuit is initially energized, said capacitor means is effectively bypassed to increase the initial current through the series circuit and enhance the preheating of said electrodes, and after said lamp is operating, said variable resistor displays sufficient resistance that it is effectively removed from the circuit.

* * * * *